United States Patent [19]

Herron et al.

[11] Patent Number: 4,813,557

[45] Date of Patent: Mar. 21, 1989

[54] PASTEURIZABLE CONTAINER CLOSURE

[75] Inventors: Gene A. Herron, Smyrna; Gerhard E. B. Nickel, Kennesaw; Alfred C. Alberghini, Dunwoody, all of Ga.

[73] Assignee: Sewell Plastics Inc., Atlanta, Ga.

[21] Appl. No.: 757,125

[22] Filed: Jul. 19, 1985

Related U.S. Application Data

[62] Division of Ser. No. 586,556, Mar. 5, 1984, abandoned.

[51] Int. Cl.[4] ..... B21D 39/00

[52] U.S. Cl. ..... 215/329; 215/1 C

[58] Field of Search ..... 215/329, 341, 343, 344, 215/1 C, 252, 354

[56] References Cited

U.S. PATENT DOCUMENTS

| | | | |
|---|---|---|---|
| 744,425 | 11/1904 | Hicks | 53/488 |
| 1,834,711 | 12/1931 | Jovignot | 53/488 |
| 2,086,552 | 7/1937 | Hogg | 53/488 |
| 2,409,788 | 10/1946 | Osborne | 53/488 |
| 2,431,114 | 11/1947 | Golding | 53/488 |
| 2,965,256 | 12/1960 | Yochem | 215/43 |
| 3,032,225 | 5/1962 | Harding | 215/329 X |
| 3,223,268 | 12/1965 | Whitchurch | 53/488 |
| 3,249,247 | 5/1966 | Babiol | 215/42 |
| 3,435,976 | 4/1969 | Owens | 215/40 |
| 3,685,677 | 8/1972 | Westfall | 215/42 |
| 3,842,574 | 10/1974 | Dickey | 53/42 |
| 3,930,588 | 1/1976 | Coursaut | 215/230 |
| 4,039,641 | 8/1977 | Collins | 264/28 |
| 4,299,328 | 11/1981 | Ochs et al. | 215/252 |
| 4,354,609 | 10/1982 | Hidding | 215/42 |
| 4,375,442 | 3/1983 | Ota et al. | 264/25 |
| 4,446,981 | 5/1984 | Libit | 215/354 |
| 4,478,342 | 10/1984 | Slater et al. | 215/1 C X |
| 4,555,208 | 11/1985 | Houdayer | 413/2 |

FOREIGN PATENT DOCUMENTS

| | | |
|---|---|---|
| 1946312 | 5/1971 | Fed. Rep. of Germany . |
| 1050765 | 9/1953 | France . |
| 16645 | 3/1914 | United Kingdom . |
| 1061686 | 3/1967 | United Kingdom . |
| 2108892 | 5/1983 | United Kingdom . |

*Primary Examiner*—Steven M. Pollard

*Attorney, Agent, or Firm*—Barnes & Thornburg

[57] ABSTRACT

A closure for bottles is disclosed which includes an internal radius support disk or cylinder for positioning within the bottle mouth to enable the bottle to resist radial inward deformation when subjected to pasteurization or other post-bottling heat treatment. The closure can be formed by coining a conventional aluminum roll-on cap blank using a pressure block having a central land projectable into the mouth of the bottle to form the support disk or cylinder from the top of the cap blank.

6 Claims, 2 Drawing Sheets

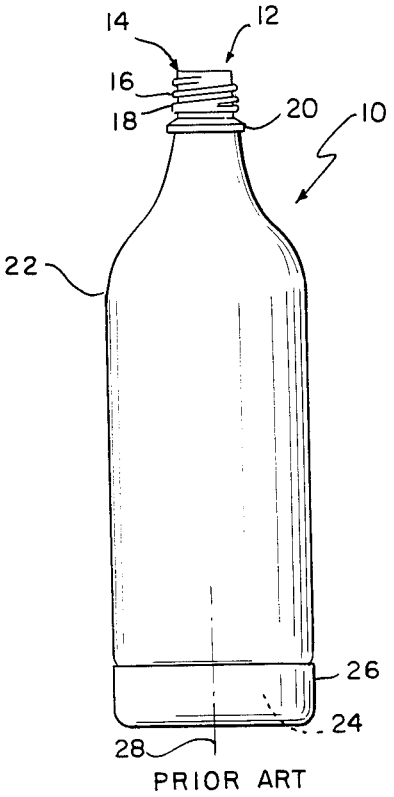
FIG. 1
FIG. 2
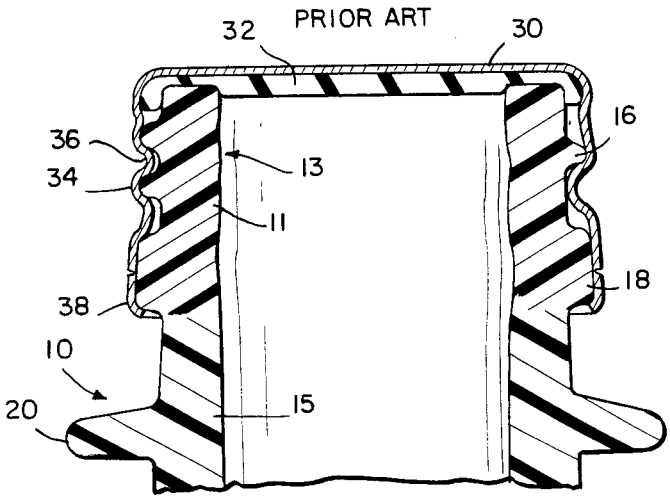
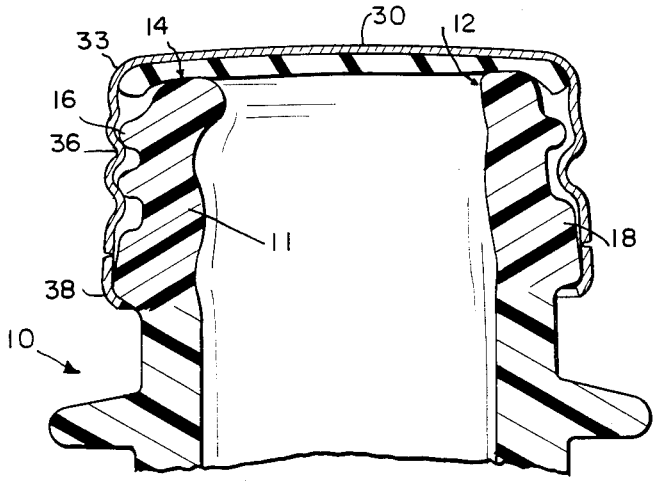
FIG. 3
FIG. 4
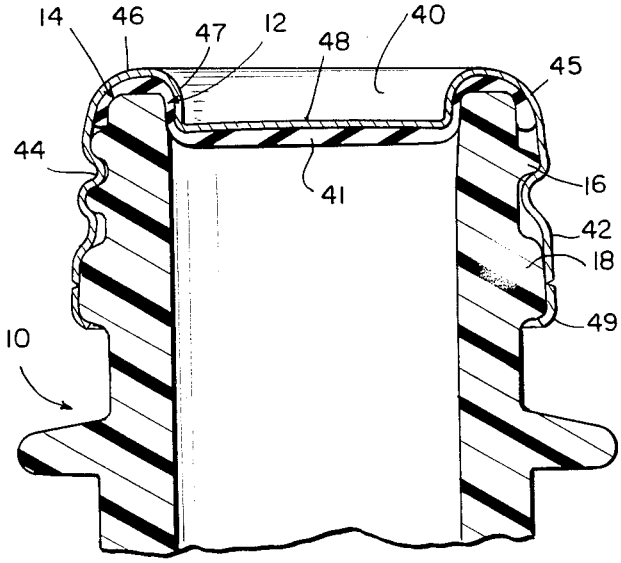
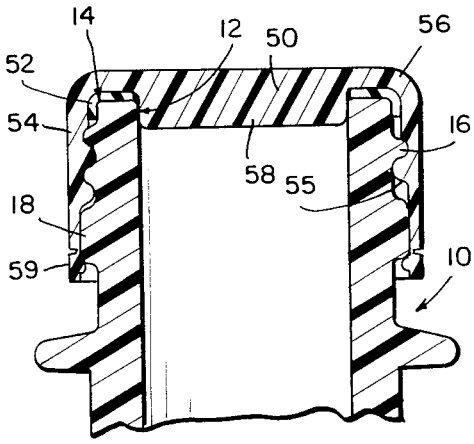
FIG. 5

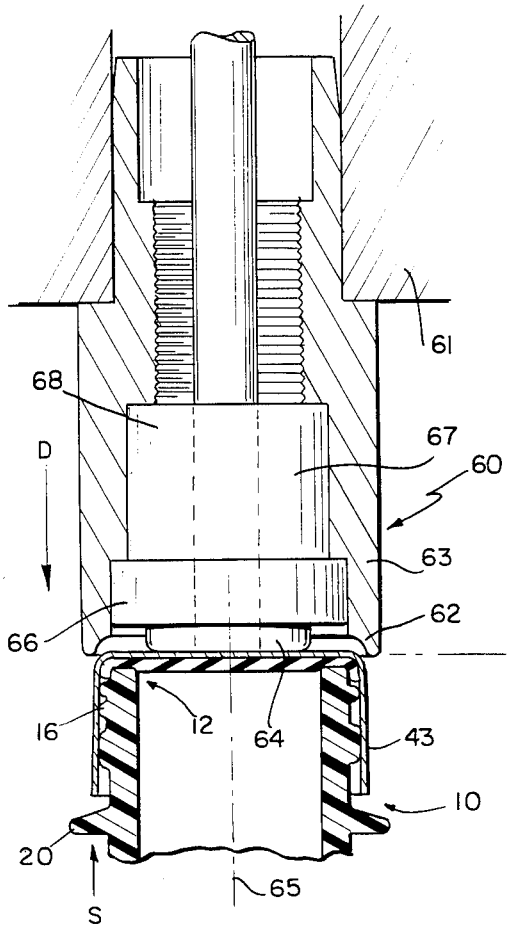
FIG. 6
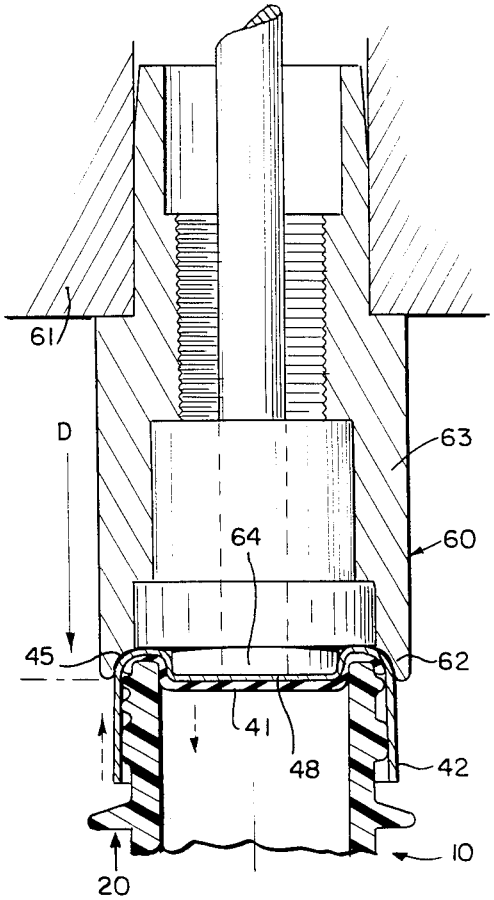
FIG. 7
FIG. 8
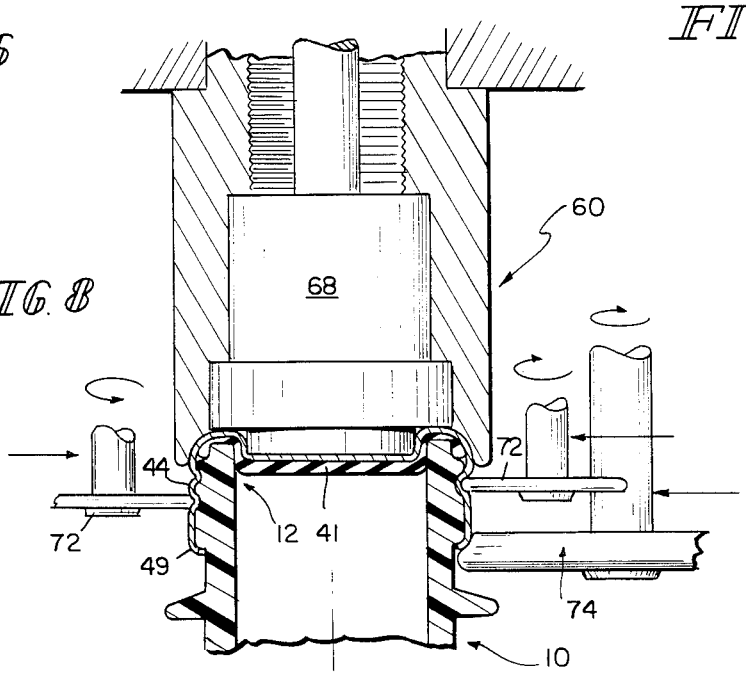

PASTEURIZABLE CONTAINER CLOSURE

This is a continuation of application Ser. No. 586,556 filed Mar. 5, 1984, now abandoned.

This invention relates generally to closures for containers formed of thermoplastic resins, and particularly to closures which are specifically designed for sealing such containers of pressurized liquids, such as carbonated beverages in situations where, after filling, the bottle and its contents will be subjected to an elevated heat treatment of one sort or another, such as pasteurization.

The use of thermoplastic resins to form bottles for containing various liquid commodities has expanded rapidly in recent years. Much of the growth has occurred in the development of non-returnable containers for carbonated beverages, the containers being typically molded of thermoplastic polyethylene terephthalate (PET). Bottles of this construction are disclosed in U.S. Pat. No. 3,733,309. The toiletry, cosmetic, detergent, and pharmaceutical markets are examples of other industries in which significant growth has occurred in the use of such plastic containers and bottles. Despite this expansion, the development of satisfactory closures for such bottles for certain products has remained illusive.

Certain products require post-bottling heat treatment, such as pasteurization, to assure stable product quality and long shelf life. An example of such a product is beer. Pasteurized bottled beer is produced by filling cold beer into previously rinsed containers which are then capped. The bottled beer is then passed through a pasteurizer where the bottle is subjected to an external spray of water for 20 minutes or more with the temperature of the water being approximately 150 degrees F. The pasteurizer is programmed such that the beer temperature rises to about 140 degrees F and is held at that temperature for about 6 minutes. The product is then cooled as it exits the pasteurizer.

Numerous closures have been employed in an attempt to seal the containers in such a manner that when subjected to the elevated temperature of pasteurization and inherent internal pressures, the integrity of the seal remains intact. One type of closure employed was the conventional aluminum roll-on closure of the type used on soft drink bottles wherein the skirt of the closure has threads or impressions formed in it by the deformation of the skirt against the finish of the container. An example of an apparatus for applying such beverage closures with a locking band (pilfer proof ring) is described in U.S. Pat. No. 3,760,561. Closures of molded plastic similar to those disclosed in U.S. Pats. Nos. 4,322,009 or 4,352,436 have also been tested. It has been observed that when PET containers are sealed with conventional aluminum roll-on caps or with plastic caps featuring a top edge seal, and the sealed containers then subjected to the pasteurization process, closure leak failures occur in more than 5% of the containers.

It has been observed that the cause for the failure is generally a reforming or a movement of the sealing surface, primarily of the bottle finish, under the temperatures and pressures involved during the pasteurization process. To overcome this problem, it has been suggested that the polyester forming the container itself be modified by a heat treatment. See, for example, U.S. Pats. Nos. 4,039,641 and 4,375,442. However, even when the bottles are heat-set and conventional closures as previously discussed are employed, the elevated temperatures and pressures of the pasteurization treatment cause the thermoplastic in the region of the finish to creep sufficiently to cause seal failure resulting in loss of carbonation and possible product contamination.

It has been suggested to provide a separate hermetic seal over the mouth of the bottle, for example, by a mylar film sonically welded to the mouth of the bottle. The presence of the welded seal is not only permitted but also desirable in certain industries, such as pharmaceuticals in that it can be used to indicate to the purchaser the absence of any tampering with the contents of the container. In other industries, however, the presence of such a seal is thought to be commercially unacceptable to the public. It is generally accepted that the presence of such a sonically welded seal on the mouth of a bottle containing beer, ale, or other malt liquor would be commercially unsatisfactory.

In accordance with the present invention, a closure is provided which includes an internal radius support means in the form of a cylinder or disk which is positioned within the container mouth to enable the container to resist radial deformation of the mouth. The cylinder or disk depends into the mouth of the container a sufficient distance to provide support with sufficient compressive strength to resist any inward radial collapse of the top edge of the opening of the container so as to maintain the integrity of contact between the sealing portion of the closure and the outer edge of the top sealing surface of the container. The support disk does not generally form a sealing contact with the inner edge of the mouth of the container. The support disk can be preformed in the cap or can be created by a forming of the cap blank at the time the cap is applied to the bottle.

The reformation of conventional aluminum roll-on caps or other caps can be achieved at the time of application by the use of a modified pressure block to form a closure in accordance with this invention. The pressure block includes a central land of a diameter slightly less than the inner diameter of the mouth of the container to which the closure is to be applied. The central land has an axial dimension sufficient to displace a central portion in the form of a disk or cylinder of the material forming the cap into the mouth of the container so as to enable the container to resist radial deformation. The skirt of the aluminum cap can be elongated slightly so as to still properly interact with the conventionally positioned pilfer-proof enlargement band on the bottle. Alternatively, a conventionally sized aluminum roll-on cap can be used with a bottle having a slightly narrower pilfer proof band.

Early experimental results suggest that the present invention is adaptable to all conventional finish sizes including both 28 mm and 38 mm. Surprisingly, it has been determined that it is no longer necessary to use bottles with heat-set finishes and instead conventional amorphus untreated bottle finishes of PET or other thermoplastic resin can be employed with the present cap with not seal failure occurring during or subsequent to the conventional beer pasteurization process.

The various features and advantages derived from the present invention can be more readily understood by a consideration of the following discussion and the accompanying drawings illustrating the prior art and the invention, and showing a preferred embodiment of the invention exemplifying the best mode of carrying out the invention as presently perceived. In such drawings:

FIG. 1 is an elevation view of a typical PET bottle on which a cap of the present invention can be employed.

FIG. 2 is a sectional detail view of a conventional PET bottle having a heat-set finish with a conventional roll-on aluminum cap properly positioned thereon.

FIG. 3 is a sectional view of the bottle and cap shown in FIG. 2 subsequent to the beer pasteurization treatment.

FIG. 4 is a sectional view of an aluminum roll-on cap in accordance with the present invention.

FIG. 5 is a sectional view of a molded plastic cap in accordance with the present invention.

FIG. 6 is a partial sectional view of a pressure block in accordance with the present invention in touching contact with a cap blank on the top of a bottle.

FIG. 7 is a sectional view of the pressure block shown in FIG. 6 in full pressure contact forming the cap blank on the top of the bottle.

FIG. 8 is a sectional view of the pressure block shown in FIG. 6 with the thread forming members engaging the skirt of the cap to roll or swage the closure threads.

A bottle 10 is shown in FIG. 1 which has been formed by conventional blow molding techniques of a suitable plastic material, such as polyethylene terephthalate, polypropylene, polyethylene, or polyvinylchloride. The bottle 10 has an opening 12 at the top which includes a top sealing surface 14 and a screw-threaded finish 16 terminating in its lower end with a pilfer-proof band 18. Spaced below the pilfer proof band 18 is a neck support ledge 20. Below the neck support ledge 20 is a tubular sidewall or body portion 22. The bottle 10 typically terminates at its lower end in a generally convex or dome-shaped pressure bottom 24 which is enclosed in a base cup 26 either cemented or snap fit to the lower end of the bottle 10. The bottle 10 is generally symmetrical about longitudinal axis 28 although various designs have been adopted particularly for the tubular sidewall portion 22 as a secondary indication of the bottle contents.

Bottles 10 having the general configuration illustrated in FIG. 1 have been subjected to a crystallization of the finish 16 in general accordance with the teachings of U.S. Pat. No. 4,375,442. A sectional detail of such a bottle 10 is shown in both FIGS. 2 and 3. In FIG. 2, the crystallized section 11 shows some small variation of the linearity of the internal surface 13 of the bottle 10 due principally to heat shrinkage which occurs during the crystallization process. The uncrystallized portion 15 of bottle 10 remains substantially undeformed even through a typical capping procedure.

In a typical capping procedure, an aluminum cap 30 is applied which includes a deformable plastic liner typically made of a moldable thermoplastic such as polyvinylchloride or ethylenevinylacetate. The cap 30 includes a flat top wall 32 and a skirt portion 34 which has been swaged by rollers against the finish 16 of the bottle 10 in order to form cooperative threads 36. The process for forming such threads is well known and disclosed, for example, in U.S. Pat. No. 3,760,561. The cap 30 also includes a pilfer-proof ring portion 38 which has been swaged under the pilfer-proof band 18 at the time the threads 36 are formed.

When a cap 30 is properly applied as shown in FIG. 2 under the usual soft drink bottling process which includes no pasteurization or other elevated temperature scheme, the cap seals satisfactorily and a negligible failure rate is observed. When such a cap is employed in bottling beer or other commodities which are then subjected to a post bottling pasteurization process as previously outlined, it has been observed that the neck portion of the bottle 10 has deformed to the shape shown in FIG. 3. Despite the fact that portion 11 of the bottle has been crystallized or heat set, considerable deformation particularly of the sealing surface 14 is observed. Tests have shown that a failure rate of more than 5% can be expected even in bottles having crystallized finishes containing beer after having completed the beer pasteurization cycle described above. The deformation observed is characterized by an essentially radial inward collapse of the mouth portion 12 which in turn causes the sealing surface 14 to draw away from the rim portion 33 of the cap 30. While in many instances the deformation of the bottle is so small as to not cause a problem, in more than 5% of the bottles, the deformation is sufficient to cause a leak to develop.

This inward deformation of the bottle mouth 12 can be prevented by use of a cap constructed in accordance with the present invention. One such cap 40 is shown in FIG. 4 to include an annular skirt portion 42 having threads 44 engaging the external screw threaded finish 16 of the container 10. A rim portion 46 integral with the top 45 of the skirt portion 42 extends radially inward from the skirt and sealingly engages the sealing surface 14 of the bottle. An internal support portion 48 is integral with the inner edge 47 of the rim portion and depends therefrom into the mouth 12 of the container. The support portion 48 has the form of a cylinder and has sufficient compressive strength to resist any radial collapse of the top edge of the opening 12 of the bottle so as to maintain the integrity of contact between the rim portion 46 of the cap 40 and the sealing surface 14 of the container 10. The cap will preferrably include a pilfer-proof ring 49 which engages the pilfer-proof band 18 of the container in the usual fashion. The cap 40 will include a conventional liner 41 similar to the linear 32 of cap 30.

An alternative embodiment of the invention is illustrated as cap 50 in FIG. 5. Cap 50 is shown to be constructed of a suitable molded plastic resin such as polypropylene; polyethylene, copolymers or mechanical blends of these, or other suitable polymers. The cap 50 can include one or more sealing rings or ridges such as are variously disclosed in U.S. Pats. Nos. 4,276,989, 4,299,328, and 4,398,645. Alternatively, the cap can include a flowed-in sealing liner 52 such as that disclosed in U.S. Pat. No. 4,331,249 the material of which may be selected from a vinylchloride type resin and can include any of those disclosed by U.S. Pat. No. 4,392,581. The cap 50 includes a skirt portion 54 having threads 55 engaging the external screw-threaded finish 16 of the container 10. The rim portion 56 including either the liner 52 as illustrated or sealing rings as disclosed in prior art, engages the sealing surface 14 of the bottle 10. An internal support portion 58 depends from the rim portion 56 into the mouth 12 of the container 10. The material selected for forming the support portion should have sufficient compressive strength to resist any radial inward collapse of the top edge 12 of the bottle 10 so as to maintain the integrity of contact between the rim portion 56 of the cap 50 and the sealing surface 14 of the container 10. The cap 50 can include a pilfer-proof ring 59 which engages the pilfer-proof band 18 of the bottle 10. The cap 50 can be applied with the aid of apparatus such as that disclosed in U.S. Pat. No. 4,308,707.

The cap shown in FIG. 4 was installed in a manner discussed below on PET bottles containing beer. The bottles did not have a heat treated or crystallized finish but instead were made of conventional amorphous untreated PET. The bottles with the cap 40 installed in place were subjected to the convention beer pasteurization treatment discussed above and no failures whatsoever were observed. It is believed that the central support portion 48 of cap 40 provided a sufficient resistance to counter any tendency for the radial collapse of the top portion of the bottle during the pasteurization procedure thereby maintaining the integrity of contact between the top sealing surface 14 of the bottle and the rim portion 46 of the cap.

The closure 40 can be formed from conventional cap blanks during the roll forming capping process by including a modified pressure block 60 such as is shown in FIGS. 6–8. The pressure block 60 is used in a conventional capping machine 61 the details of which are not shown but can comprise an apparatus such as that shown in U.S. Pat. No. 3,760,561 or other conventional machines. The pressure block 60 includes an annular ring portion 62 for ensuring the sealing engagement of the cap and the top surface of the container. The pressure block 60 also includes a central land portion 64 having a diameter less than the inner diameter of the mouth 12 of the bottle. The land 64 extends in the direction of axis 65 axailly a distance sufficient to displace a central disk or cylinder of the metal forming the cap blank 43 into the mouth 12 of the bottle 10. As illustrated, the central land portion 64 comprises one end of a cylinder 67 having three distinct radius portions including the land portion 64 and outer rim portion 66 and a body portion 68. The outer rim portion 66 and body portion 68 are snugly received within the sleeve 63 of the pressure block 60 while the central land portion 64 extends axially downward so as to project into the container mouth 12.

The method for simultaneously forming and applying a closure in accordance with the present invention is illustrated in FIGS. 6–8. As shown in FIG. 6, a conventional aluminum roll-on cap blank 43 is positioned over the finish 14 of the bottle 10 and the capping machine with the modified pressure block 60 descends to contact the top of the cap blank 43. As in the conventional process, the bottle 10 is retained and supported by the neck support 20 so that a compressive force may be applied to the cap blank 43.

As the pressure block 60 descends in direction D against the support S of the bottle 10, the central land portion 64 of the pressure block 60 contacts and depresses a central portion in the form of cylinder or disk 48 into the mouth 12 of the bottle as shown in FIG. 7. This brings the contiguous annular portion 47 into conforming relation with the cylindrical inner surface 12 of the rim of the bottle 10. The annular ring portion 62 on the lower end of sleeve 63 of the pressure block 60 then contacts the outer rim 45 to pinch the liner 41 in tight sealing relation with the sealing surface 14 of the bottle 10.

With the modified pressure block thus in place, the thread rollers 72 and the pilfer-proof band roller 74 radially contact the outer surface of the skirt 42 as shown in FIG. 8 to form the threads 44 and swage the pilfer-proof ring 49 around the bottle finish 16 in the conventional manner. The rollers 72 and 74 are then retracted and the capped bottle released from the capping machine in the usual process, leaving a cap 40 as shown in FIG. 4 firmly in place on the bottle 10.

Inasmuch as the displacement of the central disk 48 downward into the mouth of the bottle requires a slightly greater amount of aluminum than would be necessary with a flat topped cap such as is shown in FIG. 2, it is preferred that either the length of the skirt portion 42 of the cap blank be increased or the vertical dimension of the pilfer-proof band 18 on the bottle finish be shortened so as to ensure continued proper operation of the pilfer-proof ring feature in the conventional manner. An increase in skirt length of about .040 inches is believed to be sufficient to achieve the desired results. Alternatively, the lower margin of the pilerproof band may be raised by this same approximate distance to achieve substantially the same results.

While the present invention has been described with reference to a description of preferred embodiments, demonstrative, and comparative examples, it is intended that the invention not be unduly limited by this description, and instead that the invention be defined by the means and their obvious equivalents set forth in the following claims.

What is claimed is:

1. A plastic container and closure for use on the plastic container, the plastic container consisting essentially of a thermoplastic resin which is deformable when subjected to an elevated temperature equivalent to pasteurization having an opening including a top sealing surface and an externally screw-threaded finish, the container and closure containing liquid at an elevated pressure, the closure being especially adapted to assist the opening of the container to resist deformation due to exposure to said elevated temperature followd by cooling, the closure comprising a metal cap having a liner, the metal cap including an annular skirt portion having threads cooperatively engaging the external screw-threads on the finish of the container, a rim portion integral with a top of the skirt portion and extending radially inward from the skirt portion sealingly engaging the sealing surface of the container, and a disk-shaped internal support portion integral with an inner edge of the rim portion and depending therefrom into the mouth of the container so as to be positioned below the sealing surface of the container, the support portion having sufficient compressive strength to resist radial collapse of the top of the opening of the container to maintain the rim portion of the closure and the sealing surface of the container in sealing engagement during exposure of the liquid-filled container and closure to the elevated temperature and subsequent cooling so as to maintain the integrity of contact between the rim portion of the closure and the top sealing surface of the container.

2. A bottle of a carbonated beverage and a metal closure for sealing the bottle to maintain a selected pressure within the bottle where the bottle, contents, and closure are subjected to an elevated heat treatment such as pasteurization followed by cooling, the bottle comprising a plastic material which is deformable when subjected to the elevated heat treatment, the bottle being formed to include a finish portion and an end portion, the end portion having a cylindrical inner surface and an outwardly presented sealing surface, the surfaces cooperating to define a mouth for the bottle, the closure being mounted over the end portion of the bottle, the closure having a skirt surrounding and interengaged with the finish portion of the bottle to hold the closure in place on the bottle, an annular web coupled in sealing relation to the sealing surface of the bottle, and seal-maintaining means for maintaining the annular web of the closure in coupled relation to the sealing surface of the bottle during the elevated heat treatment and subsequent cooling, the seal-maintaining means comprising a radially outwardly presented side wall contiguous to the cylindrical inner surface of the end portion of the bottle and a disk projecting from an inner edge of the side wall across the mouth of the bottle, the disk and side wall providing support for the end portion of the bottle to maintain, during the heat treatment and subsequent cooling, the integrity of coupling between the outwardly presented sealing surface of the bottle and the annular web portion of the closure, whereby unwanted leakage from the bottle is prevented.

3. The bottle and closure of claim 2, wherein the side wall portion limits radially inward travel of the end portion of the bottle during the cooling of the bottle, contents, and closure.

4. The bottle and closure of claim 2 further comprising a pilfer proof ring portion joined to a lower edge of the skirt.

5. The bottle and closure of claim 2 wherein the skirt and seal-maintaining means consists essentially of metal cylinder shaped to conform to the dimensions of the bottle mouth.

6. The plastic container and closure of claim 1 wherein the container consists essentially of a thermoplastic resin selected from the group consisting of polyethylene terephthalate, polypropylene, polyethylene, polyvinylchloride, and mechanical blends and copolymers thereof.

* * * * *